US006098359A

United States Patent [19]

Stodulka

[11] Patent Number: 6,098,359

[45] Date of Patent: Aug. 8, 2000

[54] METHOD OF CONSTRUCTING A SUSPENDED FLOOR

[76] Inventor: Andrea Stodulka, 38 Sidaway Street, Chapman, ACT 2611, Australia

[21] Appl. No.: 08/894,739

[22] PCT Filed: Feb. 27, 1996

[86] PCT No.: PCT/AU96/00105

§ 371 Date: Aug. 27, 1997

§ 102(e) Date: Aug. 27, 1997

[87] PCT Pub. No.: WO96/27058

PCT Pub. Date: Sep. 6, 1996

[30] Foreign Application Priority Data

| | | | |
|---|---|---|---|
| Feb. 28, 1995 | [AU] | Australia | 13515195 |
| Jun. 9, 1995 | [AU] | Australia | PN3509 |
| Sep. 27, 1995 | [AU] | Australia | PN5667 |

[51] Int. Cl.[7] ..... E04B 1/04; E04B 1/24

[52] U.S. Cl. ..... 52/252; 52/335; 52/336; 52/326; 249/28; 249/50

[58] Field of Search ..... 52/326, 252, 319, 52/335, 336; 249/28, 50

[56] References Cited

U.S. PATENT DOCUMENTS

| | | | |
|---|---|---|---|
| 4,685,264 | 8/1987 | Landis | 52/252 |
| 4,778,144 | 10/1988 | Gregory | 249/29 |

FOREIGN PATENT DOCUMENTS

| | | |
|---|---|---|
| 168002 | 12/1953 | Australia . |
| 653697 | 10/1994 | Australia . |
| 0 049 599 | 4/1982 | European Pat. Off. . |
| 948821 | 6/1947 | France . |
| 1428749 | 3/1965 | France . |
| 1478585 | 3/1966 | France . |
| 2166335 | 1/1972 | France . |
| 2474563 | 1/1981 | France . |
| 812596 | 7/1949 | Germany . |

*Primary Examiner*—Christopher Kent
*Assistant Examiner*—Yvonne Horton Richardson
*Attorney, Agent, or Firm*—Evenson, McKeown, Edwards & Lenahan, P.L.L.C.

[57] ABSTRACT

A method of constructing a suspended floor is described in which a plurality of beam-forming formwork assemblies are located in substantially parallel alignment, the beam-forming formwork assemblies are supported in support assemblies on a support base in stable equilibrium, a plurality of floor-forming formwork assemblies are located between the beam-forming formwork assemblies for support thereon, concrete is poured in said formwork assemblies, the concrete is allowed to set, and the formwork assemblies are removed from the set concrete for re-use.

18 Claims, 12 Drawing Sheets

METHOD OF CONSTRUCTING A SUSPENDED FLOOR

TECHNICAL FIELD

This invention relates to a construction system and in particular to floor-forming formwork and to flooring systems and methods. However it will be understood that the invention is also applicable to walling formwork and to walling systems and methods.

The invention has particular but not exclusive application to flooring, to formwork therefor, and to formworking methods and systems for the construction of suspended concrete slab floors in housing, on slopes or in multilevel buildings.

BACKGROUND OF INVENTION

Construction methods are known in which prestressed concrete beams are placed at regular intervals along the supports for a suspended slab. The beams have edges which support planar sheets located therebetween and which constitute the formwork for the slab. Unless the support sheets have considerable thickness and/or strength, the beams are located relatively close to each other to prevent sagging of the support sheets when the concrete is poured and to withstand construction point loadings without failure. Centres of more than 600 mm are not recommended. An example of such a known flooring system is illustrated for comparative purposes in FIGS. 1 and 3.

It is also known in the preparation of concrete floors to locate arched formwork between supports. Australian patents 111529, 147246 and 168002 and my Australian petty patent 653697 illustrate known systems. My earlier system is also illustrated for comparative purposes in FIGS. 2, 4 and 5.

It is known to cast elongate reinforced concrete members in moulds or in a continuous or pseudo-continuous fashion. In one method, the reinforcement means is laid out and thereafter a concrete extruder is passed along the length of the reinforcement means to effectively "coat" the reinforcement means and form the elongate reinforced concrete member.

Integral slab and beam construction systems are also known. U.S. Pat. No. 4,685,264 illustrates one such system.

SUMMARY OF INVENTION

The present invention aims to provide an alternative to known construction systems and methods.

This invention in one aspect resides broadly in a method of constructing a suspended floor, the method including:

positioning a plurality of support assemblies on a support base, and suspending a beam-forming formwork assembly from each said support assembly, each said support assembly supporting the beam-forming formwork assembly suspended therefrom in stable equilibrium.

As used herein the expressions "suspend", "suspending" and "suspended", in relation to the beam-forming formwork assemblies, indicate that the beam-forming formwork assemblies hang from a support assembly.

The beam-forming formwork assemblies can be arranged in any suitable configuration. They could for example radiate outwardly from a hub, or they could be inclined at an angle. However it is preferred that the plurality of beam-forming formwork assemblies are located in substantially parallel alignment.

In a preferred embodiment the support assemblies are substantially cradle-like and have arms converging from a base to define an open neck adapted to receive a beam-forming formwork assembly therethrough for suspended support therefrom.

As used herein the expression "cradle-like" is meant to include supports which are adapted to cradle the beam-forming formwork assemblies and includes supports which are substantially U-shaped in cross-section and includes yoke-like and stirrup-like supports.

The method may also include locating a plurality of floor-forming formwork assemblies between the beam-forming formwork assemblies for support thereon.

The method may further include:

pouring concrete in the floor-forming and beam-forming formwork assemblies;

allowing the concrete to set, and removing the formwork assemblies from the set concrete for re-use.

Suitably the beam-forming formwork assemblies include a plurality of beam-forming formwork modules having a channel member constituting a mould for forming a beam, first support means associated with each flange of the channel member for engagement by the support assemblies such that the channel member is suspended therefrom in stable equilibrium, and second support means associated with each flange of the channel member for supporting floor-forming formwork assemblies transversely thereof.

In a preferred embodiment the floor-forming formwork assemblies include a plurality of floor-forming formwork modules adapted to withstand a construction point loading without failure. The floor-forming formwork modules may be fixedly mounted in mounting means adapted to be supported on the second support means. It is preferred that the floor-forming formwork modules are arched.

In another aspect this invention resides broadly in a support assembly for supporting a beam-forming formwork module having a channel member constituting a mould for forming a beam and support means associated with each flange of the channel member, the support assembly including:

a substantially cradle-like member having arms converging from a base to define an open neck adapted to receive a beam-forming formwork module therethrough such that the channel member is suspended from the support assembly by the support means and supported thereby in stable equilibrium.

It is preferred that the base is arched.

In another aspect this invention resides broadly in a formwork system for a suspended floor, the system including:

a plurality of beam-forming formwork modules each having a channel member constituting a mould for forming a beam, first support means associated with each flange of the channel member such that the channel member is supportable on a support assembly in stable equilibrium, and second support means associated with each flange of the channel member for supporting floor-forming formwork assemblies transversely thereof;

a plurality of support assemblies for supporting the beam-forming formwork modules, the support assemblies being substantially cradle-like and having arms converging from a base to define an open neck adapted to receive a beam-forming formwork module therethrough such that the channel member is suspended from the support assembly by the first support means and supported thereby in stable equilibrium, and a plurality of arched floor-forming formwork modules extendable between beam-forming formwork modules and supportable on the second support means thereof.

In another aspect this invention resides broadly in a method of constructing a suspended floor, the method including:

positioning a plurality of support assemblies on a support base;

suspending a plurality of beam-forming formwork assemblies of given cross-section from the support assemblies, the beam-forming formwork assemblies being supported thereby in stable equilibrium, and suspending a beam-forming insert in a beam-forming formwork assembly whereby a beam of lesser cross-section than the given cross-section can be formed.

It is preferred that the plurality of beam-forming formwork assemblies are located in substantially parallel alignment. The beam-forming formwork assemblies preferably include a plurality of beam-forming formwork modules having a channel member of given cross-section constituting a mould for forming a beam, first support means associated with each flange of the channel member such that the channel member is supportable on a support assembly in stable equilibrium, and the beam-forming insert preferably includes a channel member constituting a mould of lesser cross-section for forming a beam and flange means for supporting the channel member on the first support means.

In another aspect this invention resides broadly in a formwork system for a suspended floor, the system including:

a plurality of beam-forming formwork modules each having a channel member of given cross-section constituting a mould for forming a beam, first support means associated with each flange of the channel member such that the channel member is supportable on a support assembly in stable equilibrium, and second support means associated with each flange of the channel member for supporting flooring formwork assemblies transversely thereof;

a plurality of beam-forming inserts each having a channel member of lesser cross-section constituting a mould for forming a beam and flange means for supporting an insert on the first support means;

a plurality of support assemblies for supporting the beam-forming formwork modules, the support assemblies being substantially cradle-like and having arms converging from a base to define an open neck adapted to receive a beam-forming formwork module therethrough such that the channel member is suspended from the support assembly by the first support means and supported thereby in stable equilibrium, and a plurality of arched flooring formwork modules extendable between beam-forming formwork modules and supportable on the second support means thereof.

In another aspect this invention resides broadly in a flooring system for a suspended floor, the flooring system including:

a plurality of support beams having support means for supporting formwork modules, and at least one arched formwork assembly having a plurality of arched formwork modules adapted to withstand a construction point loading without failure, the modules being fixedly mounted in mounting means adapted to be supported on the support means.

The support means may comprise a step or reglet in the support beam or alternatively the support means may include a spigot located in an aperture in the support beam.

In another aspect this invention resides broadly in a method of construction including:

preparing a support base for supporting a construction;

supporting a plurality of support members on the support base, the support members having support means for supporting a formwork assembly;

locating at least one arched formwork assembly between the support members to constitute formwork for the construction, the arched formwork assembly having a plurality of arched formwork modules fixedly mounted in mounting means adapted to be supported on the support means, and placing concrete in the formwork to form the construction.

In one preferred embodiment the construction is a suspended floor and in another embodiment the construction is a wall.

In another aspect this invention resides broadly in a method of constructing a suspended floor, the method including:

preparing a support base for supporting the suspended floor;

locating a plurality of support beams on the support base, the support beams having support means for supporting a formwork assembly;

locating at least one arched formwork assembly between the beams to constitute formwork for the suspended floor, the arched formwork assembly having a plurality of arched formwork modules adapted to withstand a construction point loading without failure, the modules being fixedly mounted in mounting means adapted to be supported on the support means, and placing concrete in the formwork to form a suspended slab floor.

In another aspect this invention resides broadly in a method of constructing a suspended floor, the method including:

preparing a support base for supporting the suspended floor;

locating a plurality of beam-forming formwork assemblies on the support base, the beam-forming formwork assemblies having support means for supporting floor-forming formwork modules;

locating a plurality of arched floor-forming formwork modules on and between the beam-forming formwork assemblies to constitute formwork for the suspended floor, the floor-forming formwork modules being adapted to withstand a construction point loading without failure, and placing concrete in the formwork to form the construction;

the arrangement being such that the beam-forming formwork assemblies and/or the floor-forming formwork assemblies can be re-used.

In another aspect this invention resides broadly in a method of constructing a suspended floor, the method including:

preparing a support base for supporting the suspended floor;

locating a plurality of beam-forming formwork assemblies on the support base, the beam-forming formwork assemblies having support means for supporting a floor-forming formwork assembly;

locating a plurality of arched floor-forming formwork assemblies on and between the beam-forming formwork assemblies to constitute formwork for the suspended floor, the arched floor-forming formwork assemblies having a plurality of arched floor-forming formwork modules adapted to withstand a construction point loading without failure, the modules being fixedly mounted in mounting means adapted to be supported on the support means, and placing concrete in the formwork to form the construction;

the arrangement being such that the beam-forming formwork assemblies and/or the floor-forming formwork assemblies can be re-used.

In another aspect this invention resides broadly in a method of construction including:

aligning a plurality of rib-forming formwork assemblies having a plurality of rib-forming formwork modules, the modules having a channel member constituting a mould for forming a rib and support means associated with each flange of the channel member for supporting panel-forming formwork assemblies transversely thereof to form one surface of a panel;

locating a plurality of panel-forming formwork assemblies between the rib-forming formwork assemblies for support thereby;

pouring concrete in the panel- and rib-forming formwork assemblies;

allowing the concrete to set, and removing the formwork assemblies from the set concrete for re-use.

The panel may comprise a floor, wall or any other type of panel.

The formwork assemblies may be located adjacent an embankment to form a retaining wall. Alternatively other panel-forming formwork assemblies may be located opposite the plurality of rib- and panel-forming formwork assemblies to form the other surface of the panel.

The other panel-forming formwork assemblies may be planar formwork. Alternatively other rib-forming formwork assemblies can be located opposite the plurality of rib-forming formwork assemblies to form ribs on the other surface of the panel.

The opposed rib-forming formwork assemblies may be located directly opposite each other. Alternatively, the other rib-forming formwork assemblies can be offset relative to the plurality of rib-forming formwork assemblies.

The opposed formwork assemblies may be independently or separately supported before and during the pouring of concrete. However it is preferred that the pluralities of rib-forming and panel-forming formwork assemblies are braced relative to the other rib-forming and panel-forming formwork assemblies before the concrete is poured.

DESCRIPTION OF DRAWINGS

In order that this invention may be more easily understood and put into practical effect, reference will now be made to the accompanying drawings which illustrate a preferred embodiment of the invention, wherein.

DESCRIPTION OF PREFERRED EMBODIMENT OF THE INVENTION

Figure 1:
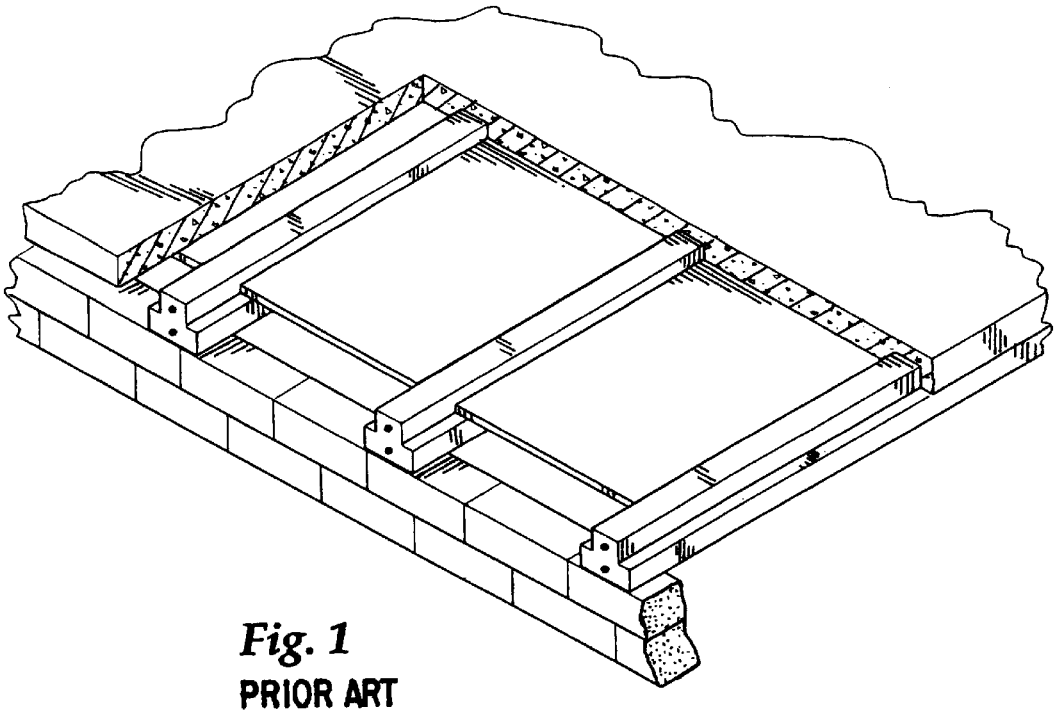
Fig. 1 PRIOR ART
FIGS. 1 to 5 illustrate known construction systems.
Figure 2:
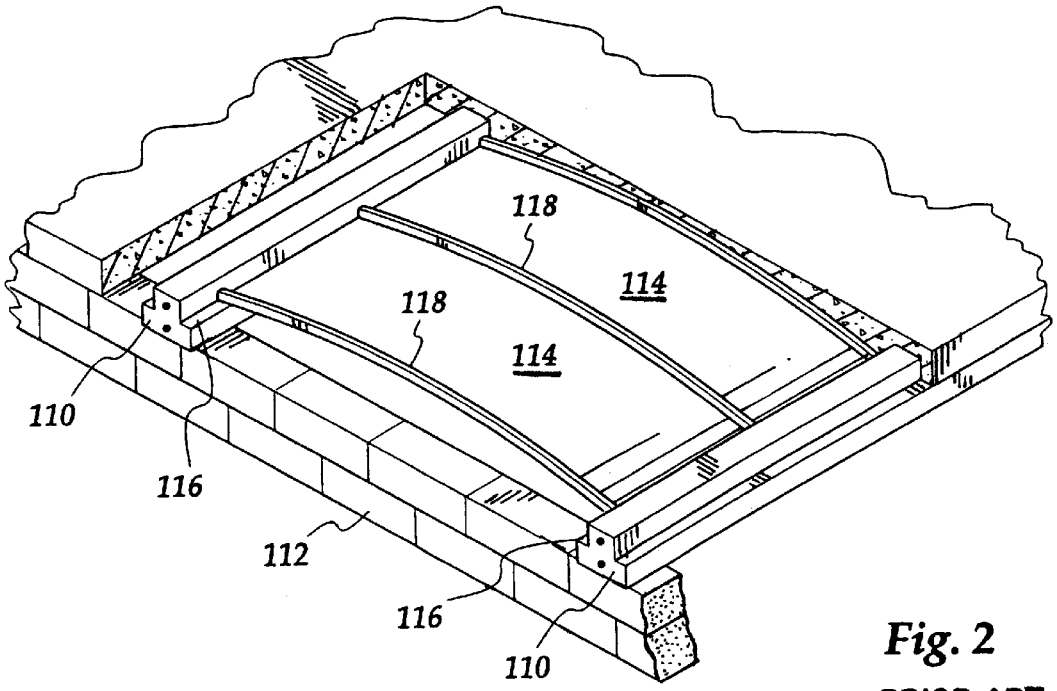
Fig. 2 PRIOR ART
Figure 3:
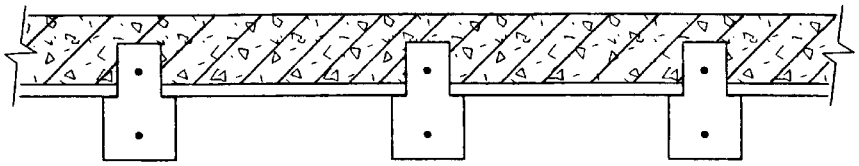
Fig. 3 PRIOR ART
Figure 4:
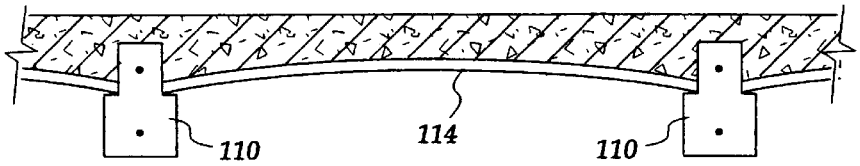
Fig. 4 PRIOR ART
Figure 5:
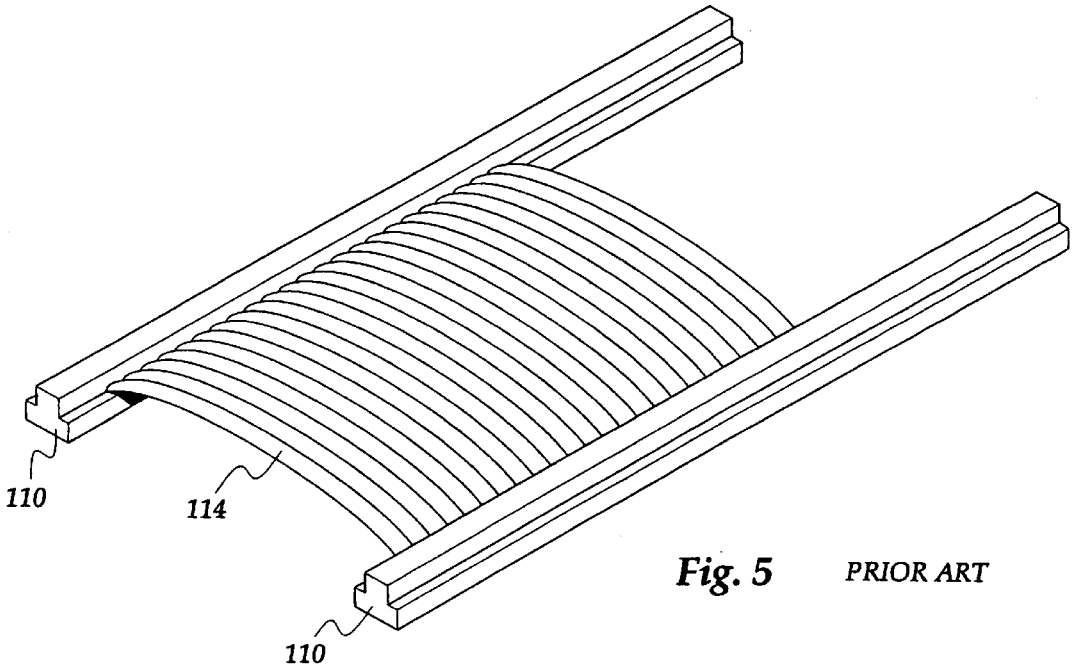
Fig. 5 PRIOR ART

As illustrated in FIGS. 2 and 4, in my earlier suspended slab flooring system prestressed beams 110 are spaced apart and located on supporting brick work 112. Arched flooring supports 114 are seated on beam ledges 116 in an overlapped array so that the space between adjacent beams is filled. The arched floor supports may include strengthening ribs 118 formed in the sheet material in a circumferential direction. As can be seen in FIG. 5, the arched flooring supports can be lengths of corrugated material having a curvature in the direction of the corrugations.

Figure 6:
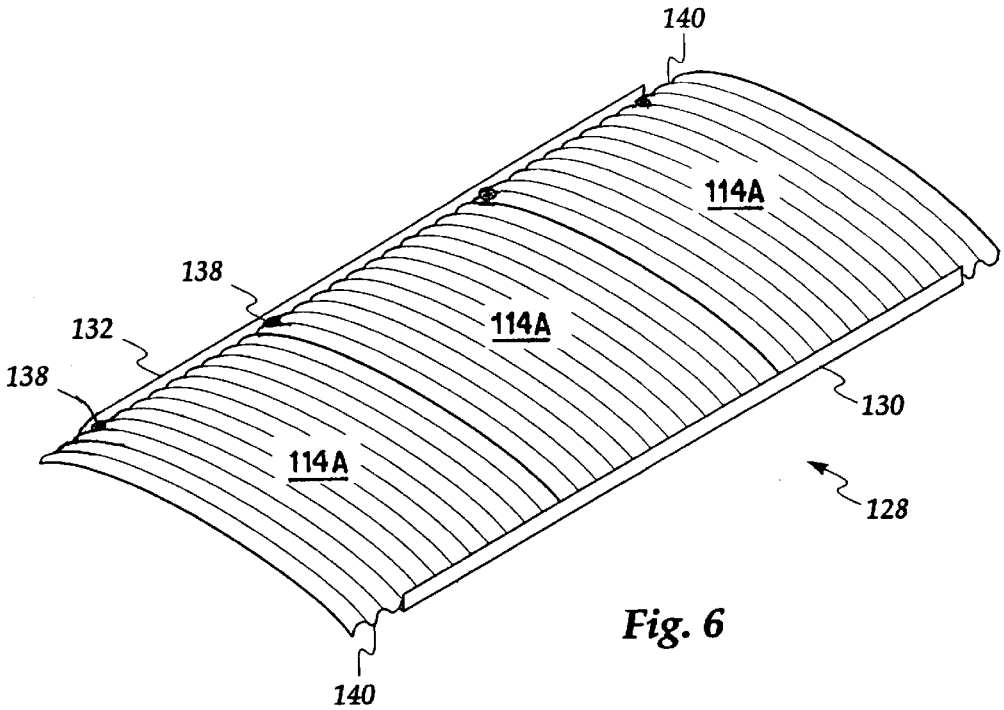
FIG. 6 is a perspective view of a formwork assembly used in the system.
Figure 7A:
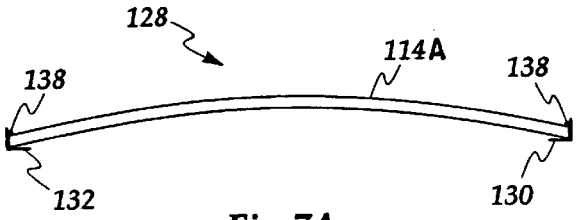
FIGS. 7A and 7B are end and plan views respectively of the formwork assembly illustrated in FIG. 6.
Figure 7B:
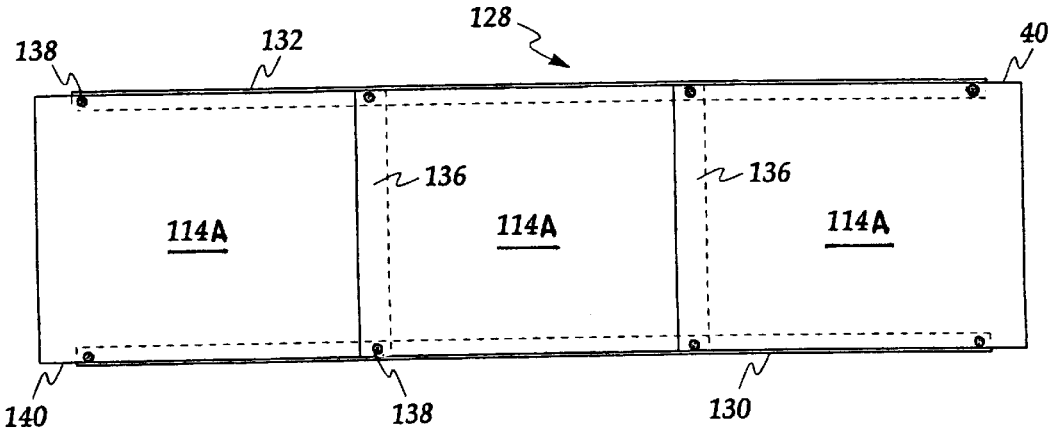

Alternatively as seen in FIGS. 6, 7A and 7B, an arched formwork assembly 128 according to the invention can be utilized. Formwork assembly 128 has a number of arched formwork modules 114A located on a pair of side rails 130,132 in the form of angles although other rails such as flats or channels can be used. The formwork modules 114A are positioned on rails 130,132 in overlapping array to provide overlapping segments 136 and fixed to rails 132 by spot welds 138. Rails 130,132 do not extend to the ends of the outer modules 114. Because rails 130,132 stop short of the ends, end edges 140 can overlap and nest with corresponding end edges on adjoining formwork assemblies.

The formwork assembly illustrated has three lengths of arched corrugated material, each 900 mm in length with a nominal span of 1200 mm. The formwork assembly is approximately 2700 mm long and spans 1200 mm.

The arched supports may be made from aluminium, zinc alumina, fibro cement, concrete, galvanised iron or steel, plastics or other suitable material.

In use, prestressed beams are located as described above with regard to the prior art, and arched formwork assemblies 128 and/or formwork modules 114A are placed between adjacent beams in overlapping array. Concrete is then poured to a depth above the top of the beams.

Figure 8:
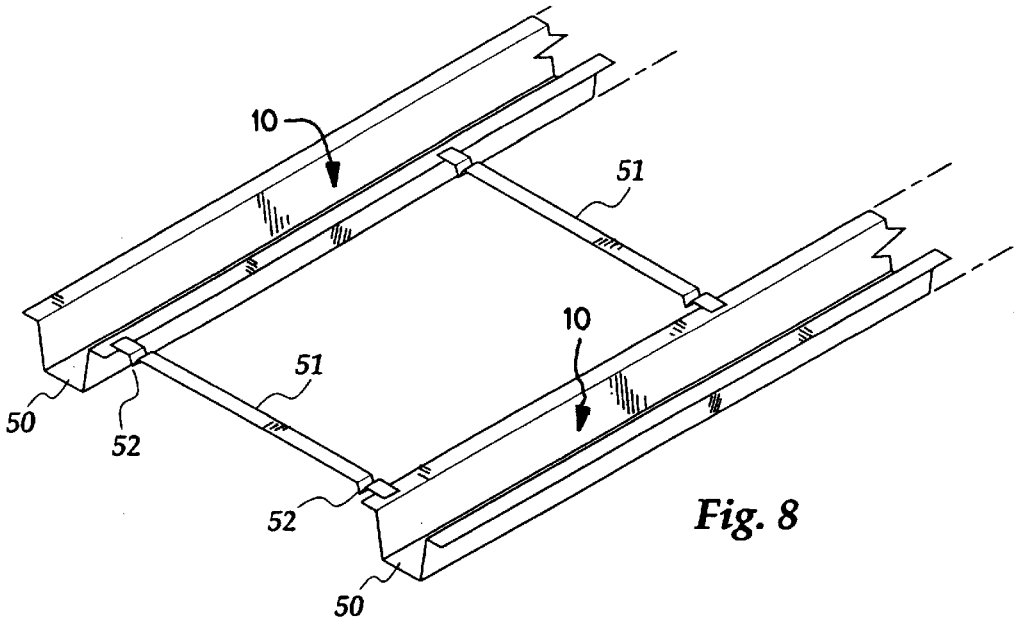
FIGS. 8 to 10 illustrate a construction system in accordance with the invention wherein un-stressed beams are poured in-situ with the arched form work therebetween.
Figure 9:
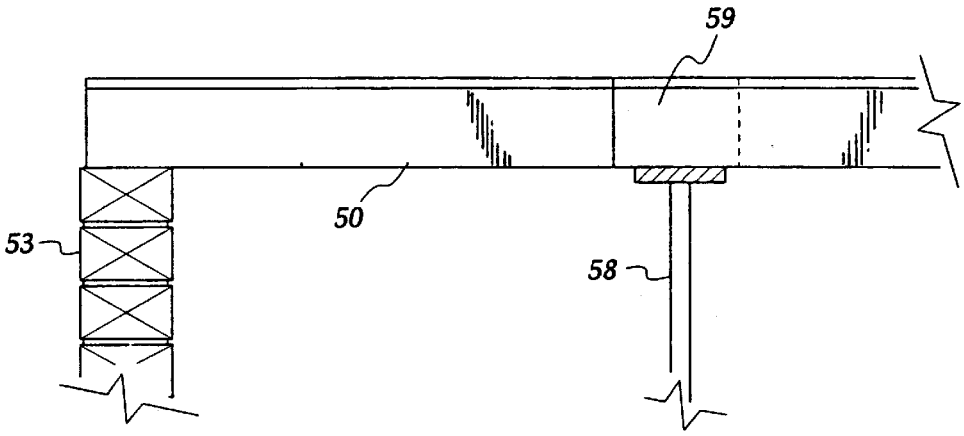
Figure 10:
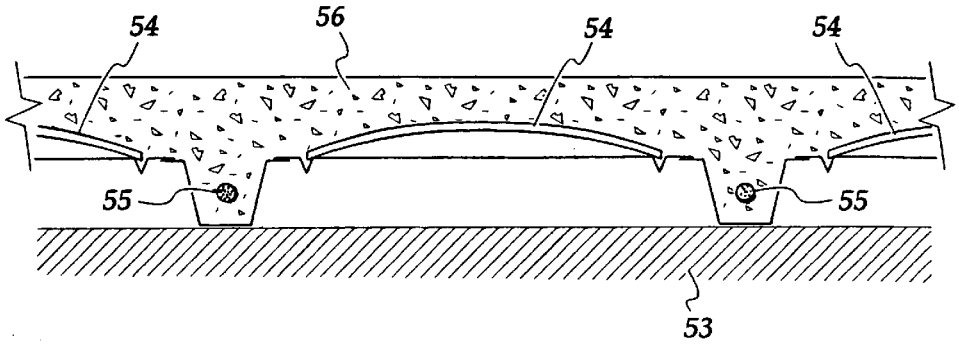

As can be seen in FIGS. 8 to 10 a construction system in accordance with the invention need not utilize pre-stressed beams and beams may be poured in-situ with formwork therebetween. It will be appreciated that whilst arched formwork modules are described and illustrated, in this aspect of the invention the floor-forming formwork modules spaced between the integrally formed beams need not be arched.

Channel shaped formwork 50 includes a beam-forming channel 10 for the beams is linked to an channel shaped formwork by link arms 51 having notches 52 for receiving the edges of arched formwork modules or assemblies 54. Link arms 51 are spot welded to channel shaped formwork 50 along the length thereof. The channel assemblies are placed in side-by-side array on support wall 53 as seen in FIG. 9. Reinforcing steel 55 is placed in the channels, arched support assemblies or modules 54 placed therebetween and concrete 56 poured as seen in FIG. 10. The channel shaped formwork 50 overlap at junction 59 and at this junction the assembly is supported by a vertical support post 58 as seen in FIG. 9. Other supporting arrangements are possible such as running a bar through lugs located on the base of beam forming channel 10.

Figure 11:
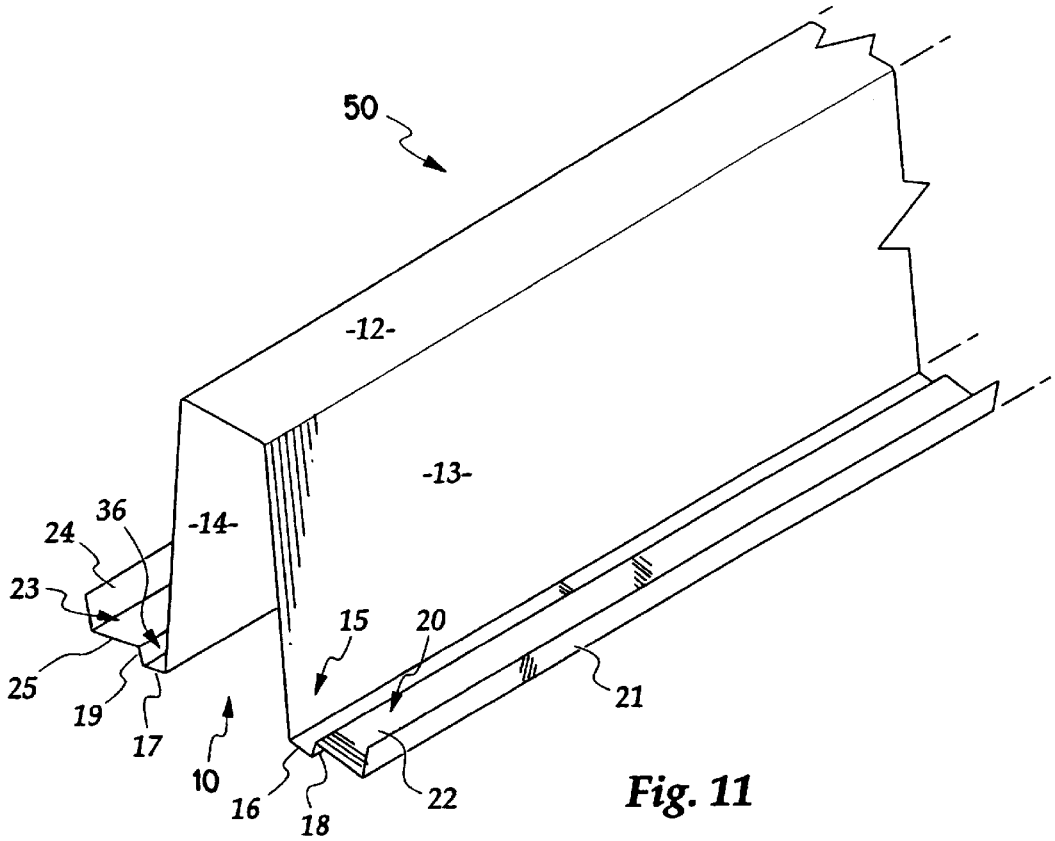
FIG. 11 illustrates beam-forming formwork for an integral reinforcing beam in the construction system.

As can be seen in greater detail in FIG. 11; the channel shaped formwork 50 shown inverted, beam includes forming channels 10 formed by base 12 and inclined sidewalls 13 and 14. Side channels 15 and 36 are formed at the outer edge of sidewalls 13,14. Channels 15 and 36 are formed respectively by bases 16,17 and side walls 13,14 and 18,19. Angle sections 20, 23 extend outwardly from the outer edge of side walls 18,19 and are formed respectively by legs 22,21,25 and 24.

If beam forming channels 10 are directly supported on their base 12 during preparation of the slab formwork in the manner illustrated in FIG. 9, the formwork assembly may tend to become unstable. In accordance with the present invention the formwork assembly can be supported in stable equilibrium by supporting beam channels 10 along portions of their side channels 15, 36 in stirrup-, cradle- or yoke-like supports.

Figure 12:
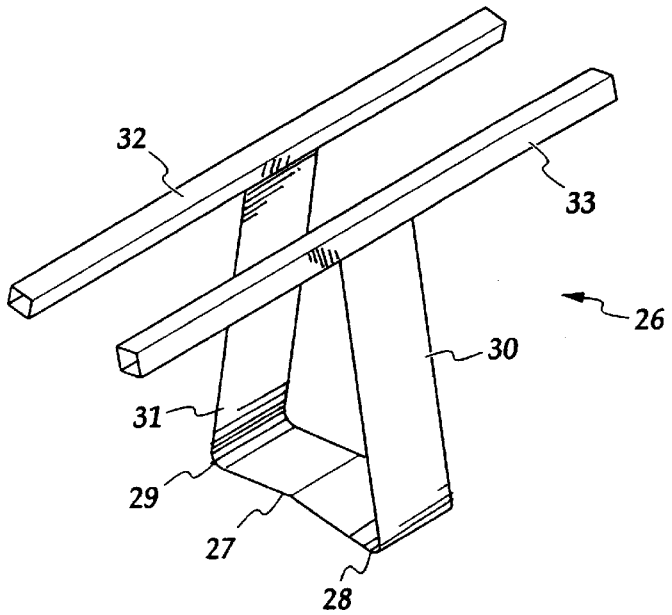
FIGS. 12 and 14 illustrate formwork supports for supporting the formwork of FIG. 11.
Figure 14:
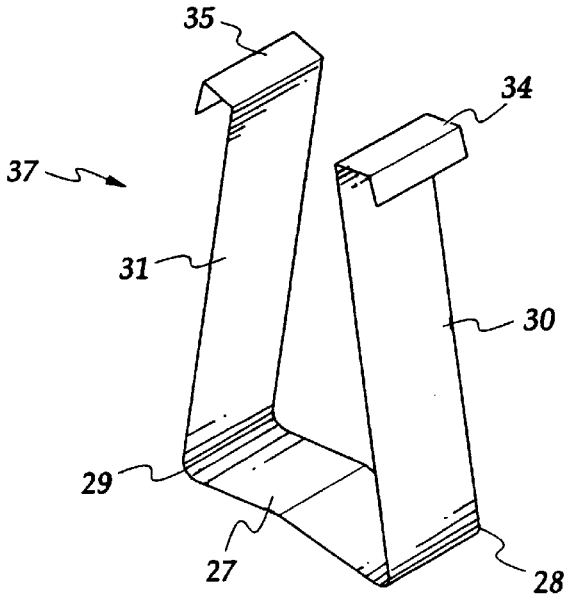

As can be seen in FIGS. 12 and 14 stirrup supports 26,37 have a pair of side arms 30,31 converging from an arched base 27 to an open neck. Arched base 27 meets sidearms 30,31 at corners 28,29. The upper ends of side arms 30,31 are curled over as in FIG. 14 to form support channels 34,35 or alternatively as seen in FIG. 12, support arms 33,32 in the form of lengths of box tubing are welded thereto. The depth of the stirrup support is greater than the depth of the beam channel.

Figure 13:
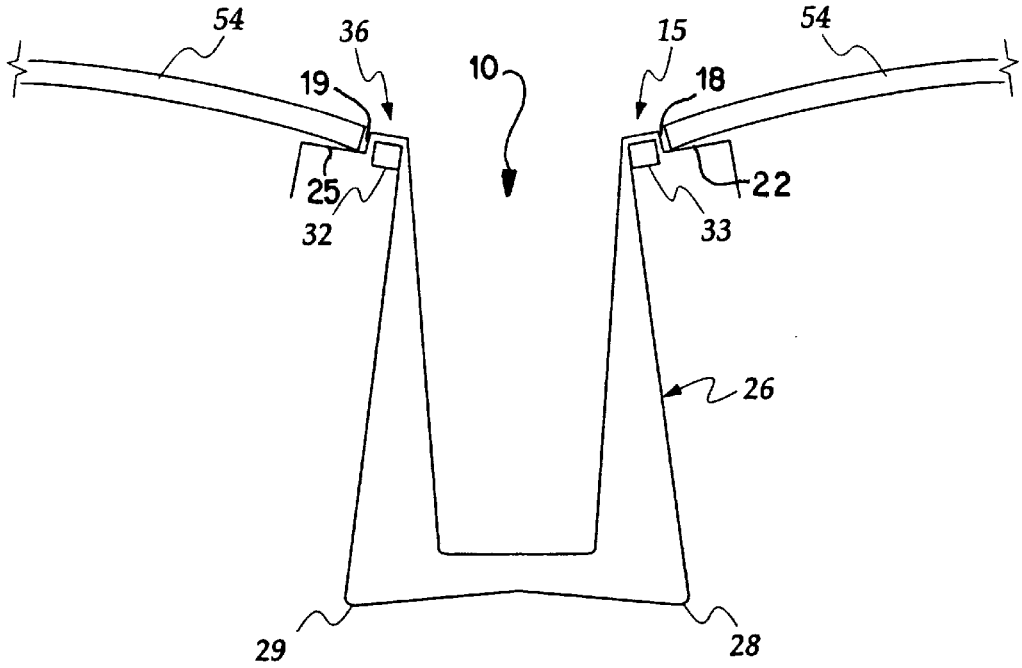
FIG. 13 is a cross-sectional view of the formwork support of FIG. 12 supporting the formwork of FIG. 11.

FIG. 13 illustrates a beam forming channel 10 supported in stirrup support 26 by engagement of arms 33,32 in side channels 15,36. It can also be seen in this illustration how arched formwork modules 54 are seated in steps in the channel shaped formwork modules 50 formed by sidewalls 18,19 and legs 22,25.

Figure 17:
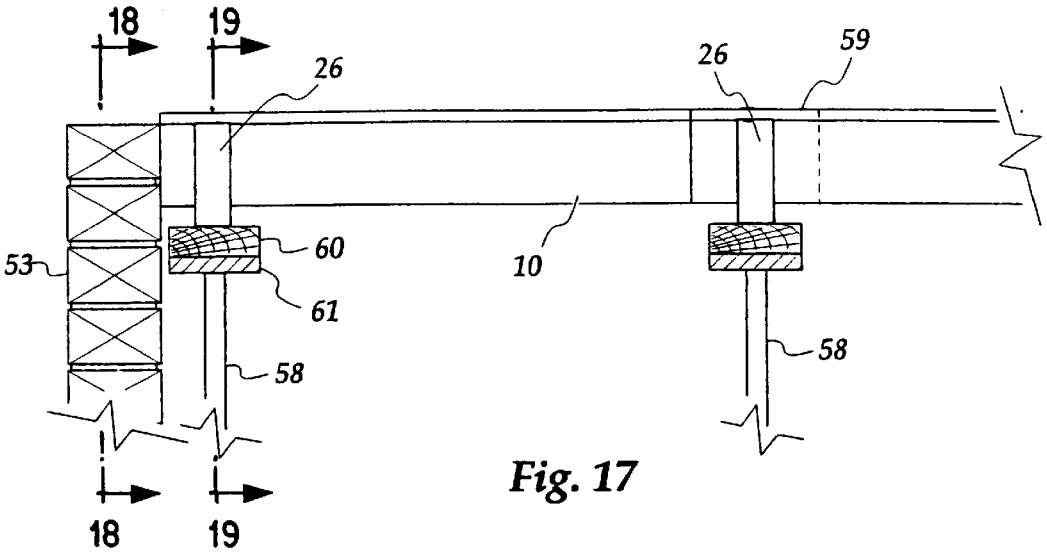
FIG. 17 is a side elevation of the construction system showing the formwork in place before the floor is poured.
Figure 18:
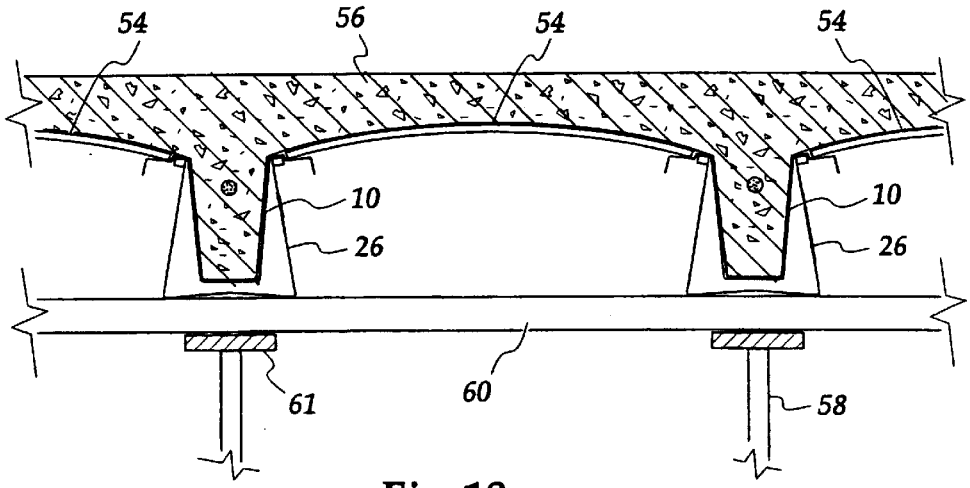
FIGS. 18 and 19 are sectional elevations of the system as illustrated in FIG. 17 along sections BB and AA respectively.

When corners 28,29 of stirrup support 26 are positioned on a supporting member (for example a timber beam 60 as seen in FIGS. 17 and 18), it can be seen in FIG. 13 that beam forming channel 10 is supported in stirrup support 26 in stable equilibrium in that the points of support of arched formwork modules 54 with stirrup support 26 on legs 22,25 are inwardly disposed relative to corners 28 and 29. Furthermore, when load is applied to the arched modules 54 under the load of concrete being poured, a degree of resilience in the arched module permits the module to flex downwardly under load thereby shifting the points of contact further inwardly of corners 28 and 29 and tending to close the gap between the edge of modules 54 and sidewalls 18 and 19. The gap is largely self-sealed and should the gap remain it will seal with concrete during the pour.

In use, particularly during slab formwork preparation when workers will be walking across arched formwork modules 54, it can be seen that downward force is applied inwardly of support corners 28,29 and consequently there is no tendency for stirrup support 26 to rotate about support corners 28,29. Moreover the suspended support of beam-forming channels 10 in stirrup supports 26 supports the slab in stable equilibrium during the pour and prior to stripping the formwork from the cured slab for re-use.

Stirrup support 26 are resilient and arms 30,31 can flex about arched base 27 which can also flex under load. Consequently during the pour, the downward force from the weight of concrete in beam channels 11 as the pour commences results in the support arms of the stirrup support being firmly engaged in the upper channels of the beam channels thereby enhancing the stability of the formwork system.

Figure 15:
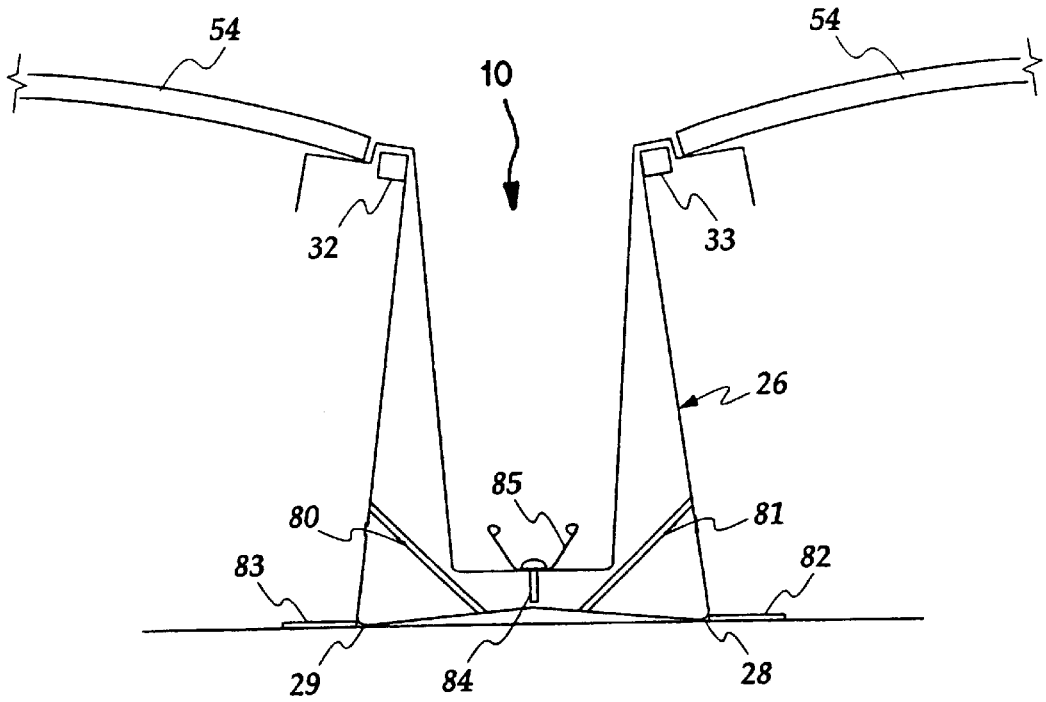
FIGS. 15 and 16 illustrate optional features for the formwork support.
Figure 16:
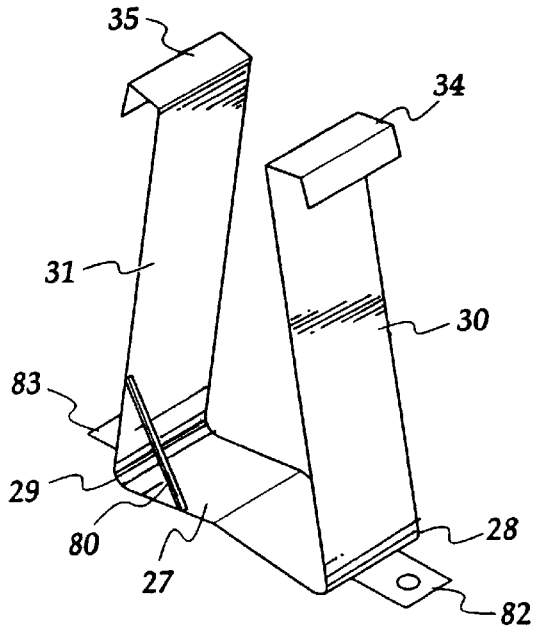

As can be seen in FIGS. 15 and 16, stirrup supports 26 can include a pair of opposed members 80,81 adapted to restrain beam-forming channels 10 against lateral movement, and a pair of ears 82,83 having apertures therein for nailing the support stirrup to a timber beam on which it is supported. Other ears (not shown) can be affixed perpendicular to those illustrated whereby the stirrup supports can be nailed to the edge of the timber beam. The base 12 of beam-forming channel 10 can have apertures through which a screw 84 can be located for supporting timber battens or the like once the floor has been cast. Screw 84 is fixed to wire tie 85 for retaining the screw within the cast beam.

Figure 19:
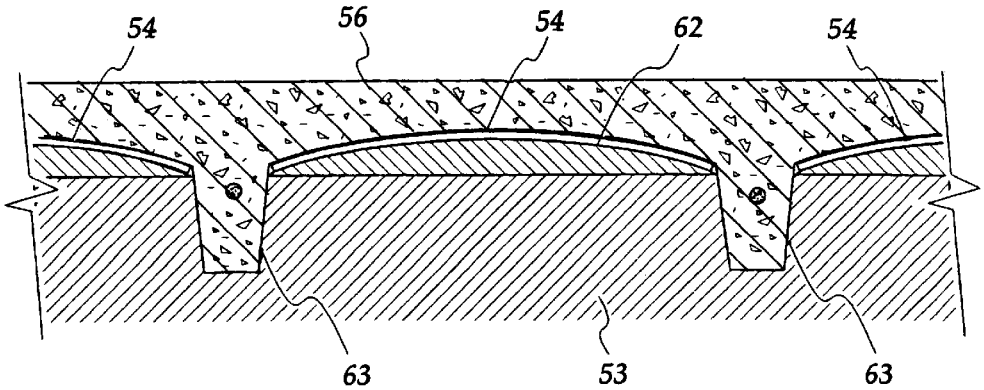

In use as seen in FIGS. 17 to 19, beam-forming channels 10 overlap at junction 59 and are supported on stirrups 26 by timber beam 60 which is in turn supported by a vertical support post 58 and pad 61. The outer ends of beam-forming channels 10 abut the inner face of brick supporting wall 53. FIG. 19 illustrates recesses 63 which are made in the wall for forming an extension of the beam onto the supporting wall, and also illustrates grouting 62 which is packed on the wall to support the arched formwork modules 54.

Figure 27:
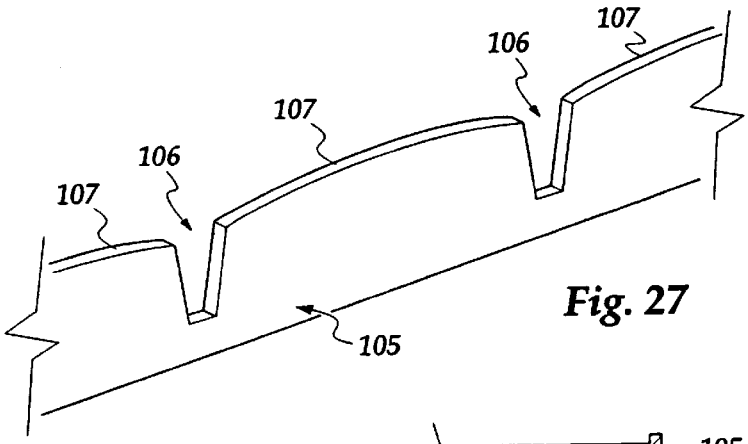
FIG. 27 illustrates boxing formwork for use when a transverse support beam is integrally cast with a suspended slab.
Figure 28:
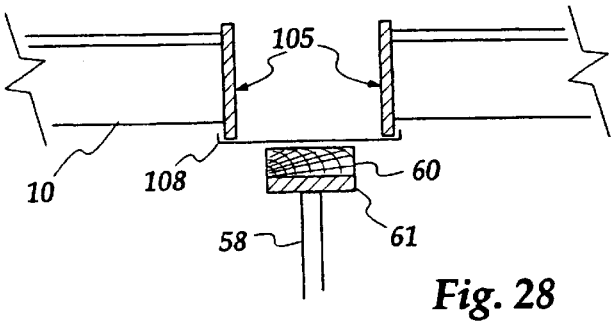
FIG. 28 is a cross-sectional view showing the formwork in place before pouring a suspended slab having an integrally cast transverse support beam.

As can be seen in FIGS. 27 and 28, a transverse support beam can be cast integrally with the suspended floor. Formwork battens 105 are located at opposite sides of support plate 108 which is supported on beam 60 as described above. Battens 105 have cutouts 106 for receiving and supporting the ends of beam-forming channels 10, and arches 107 for supporting the arched formwork modules 54 which for the sake of clarity have not been illustrated in FIGS. 17 and 28.

When the slab has cured the formwork can be stripped for re-use. Vertical supports 58 are removed together with timber beams 60 enabling stirrup supports 26 to be released. The channel shaped formwork modules 50 are then stripped from the beams allowing the arched formwork modules 54 to be stripped from the slab. Similarly if a transverse support beam has been formed, removal of vertical support 58 and beam 60 allows support plate 108 to be removed. Battens 105 are then removed downwardly away from the floor beams.

Figure 20:
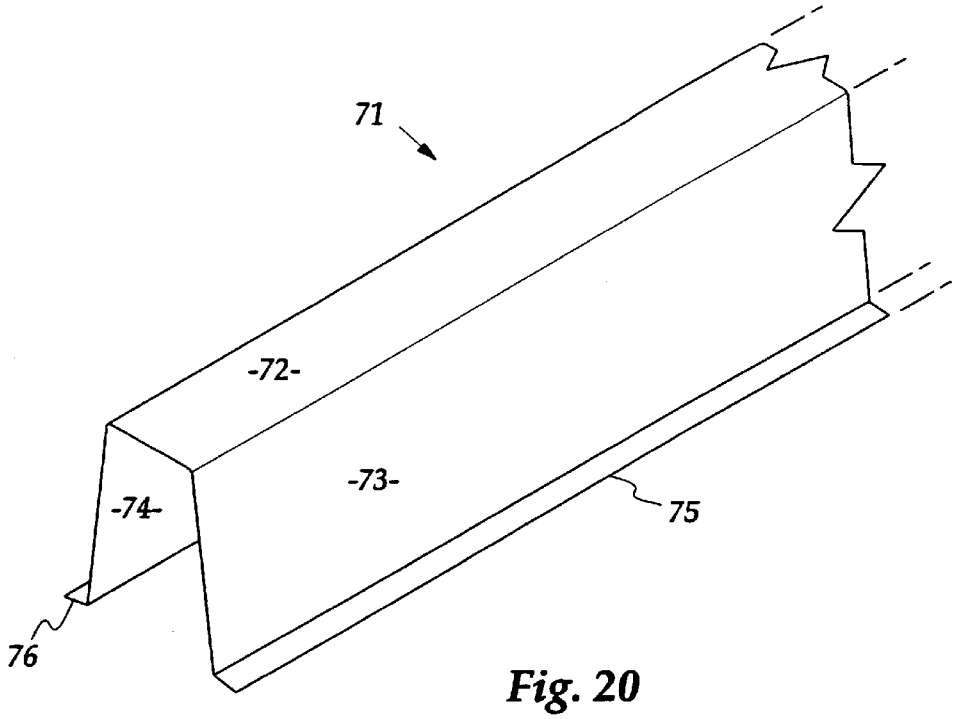
FIG. 20 is a perspective view of a beam-forming insert.

So that smaller dimension beams may be formed simply by placing appropriate formwork channels in the standard formwork assemblies when constructed, a beam-forming insert 71 is provided and as seen in FIG. 20, consists of a channel having sides 73 and 74 and base 72. A pair of flanges 75 and 76 extend outwardly of the upper edges of sides 73 and 74 and are adapted to sit on the upper supports of beam-forming channel 10 by means of which beam-forming channel 10 is suspended in support assembly 26 (as seen in FIG. 13).

Figure 21:
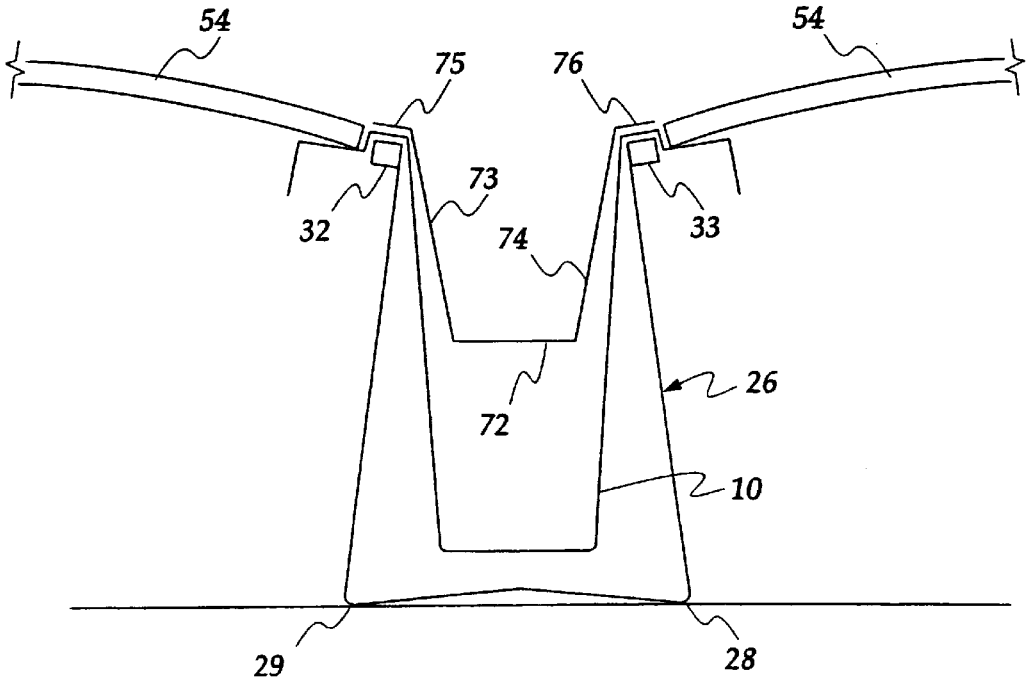
FIGS. 21 and 22 illustrate beam-forming inserts of lesser cross-section suspended in the beam-forming channel.
Figure 22:
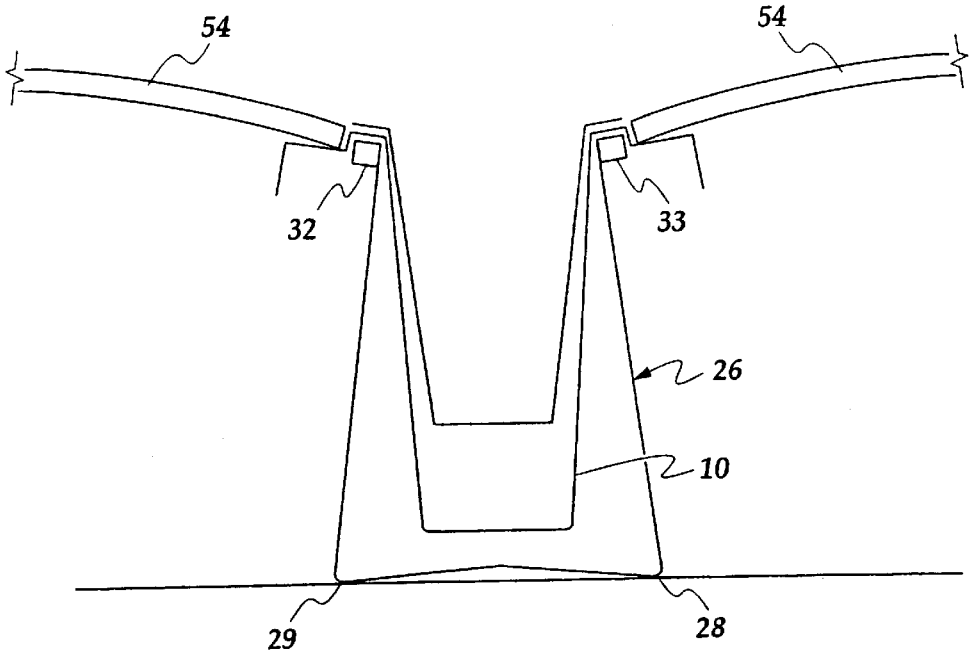

FIGS. 21 and 22 illustrate differing sized beam-forming inserts positioned in beam-forming channel 10. The inserts illustrated have uniform depth however it will be appreciated that the inserts can have variable depth along the length of the insert to facilitate the construction of a beam of variable depth.

If it is desired that a ceiling be affixed to the underside of the floor, as for example in a multi-level building, timber battens can be located in the bottom or against the sides of beam-forming channel 10 before the pour. The battens are thus exposed after the formwork is stripped and a ceiling can more easily be nailed to the timber battens than gun-nailed to the concrete beam.

It will be appreciated that beam-forming channel 10 may be used as a rib-forming channel together with formwork modules 54 in the construction of walls.

Figure 23A:
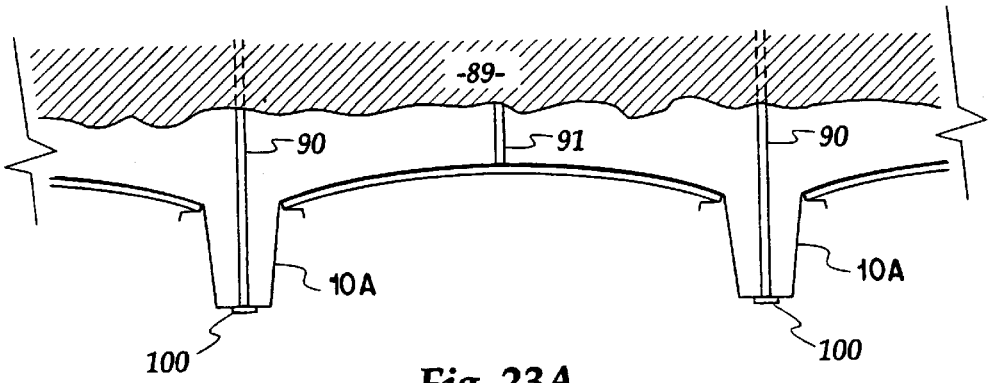
FIGS. 23A and 23B are sectional elevations of a retaining wall constructed in accordance with the invention.
Figure 23B:
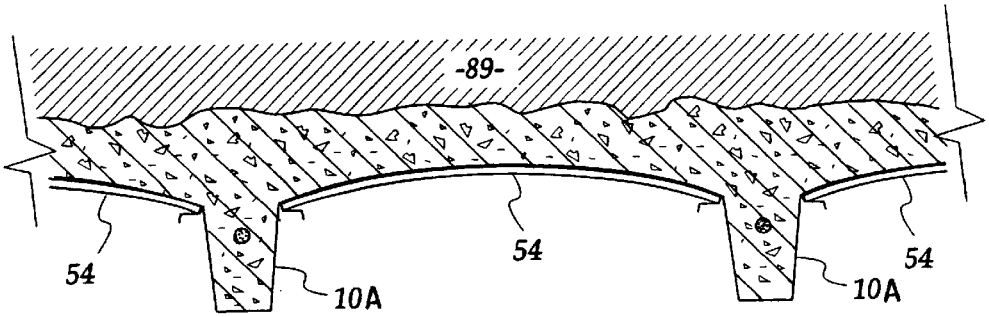

As can be seen in FIGS. 23A and 23B, rib-forming channels 10A are spaced relative to embankment 89 by stays 90 and formwork modules 54 mounted against the support flanges of rib-forming channel 10A as described above and spaced from embankment 89 by struts 91. Stays 90 are releasably capped by caps 100 and when the concrete is set after pouring, rib-forming channels 10 are stripped by removing releasable caps 100 and then formwork modules 54 are stripped for re-use.

Figure 24A:
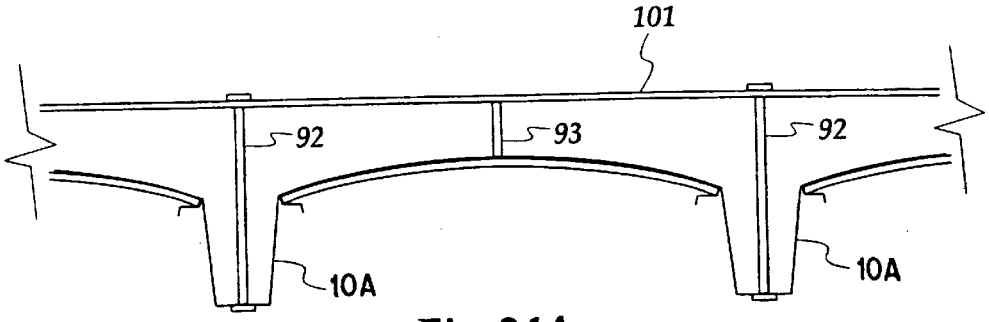
FIGS. 24A and 24B, 25A and 25B, and 26A and 26B are sectional elevations illustrating alternative walls constructed in accordance with the invention (FIGS A and B showing the formwork before and after pouring respectively)
Figure 24B:
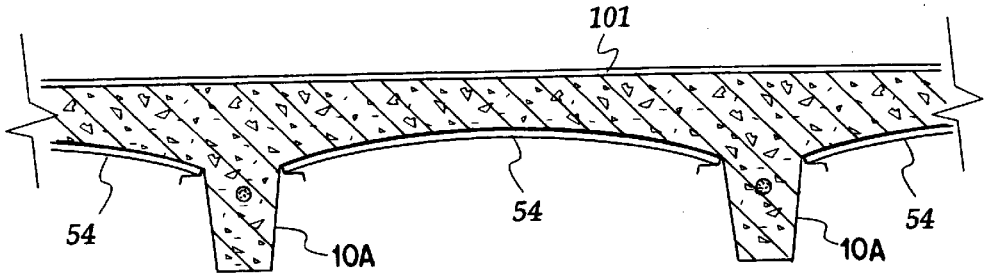

Alternatively as seen in FIGS. 24A and 24B, a wall ribbed on one side and planar on the other can be constructed by spacing rib-forming channels 10A relative to planar formwork 101 by means of stays 92 with formwork modules 54 being mounted against the support flanges of the channels by struts 93.

Figure 25A:
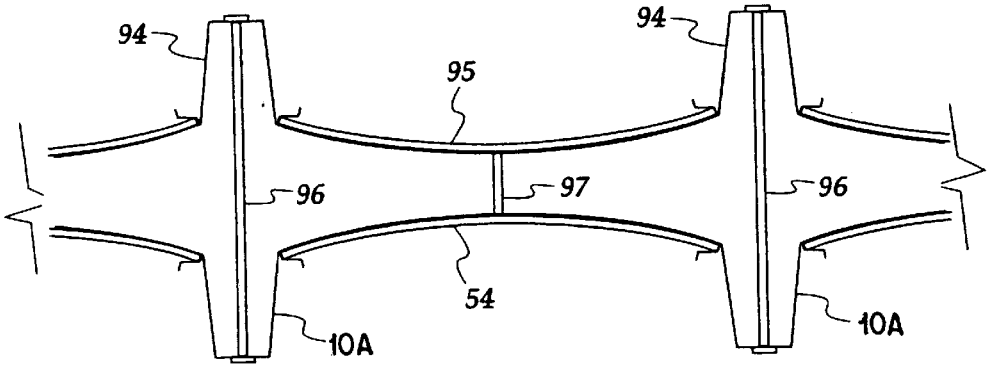
Figure 25B:
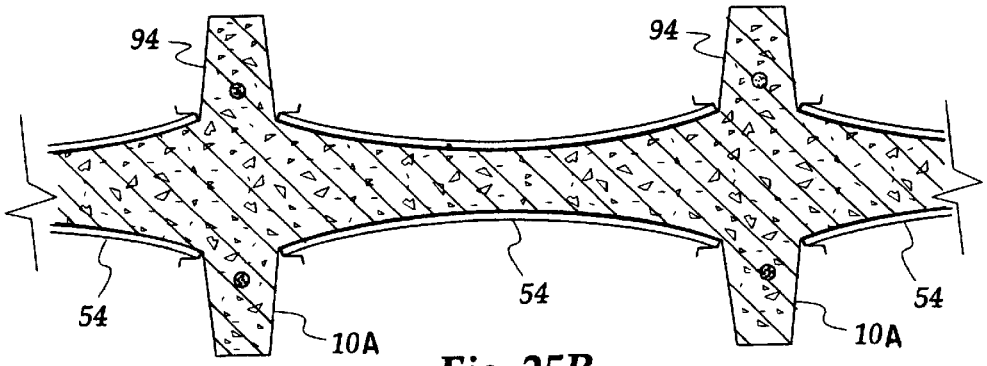

In another embodiment seen in FIGS. 25A and 25B, a double ribbed wall is constructed by spacing rib-forming channels 10A relative to other rib-forming channels 94 by means of stays 96 and spacing formwork modules 54 relative to other formwork modules 95 by struts 97.

Figure 26A:
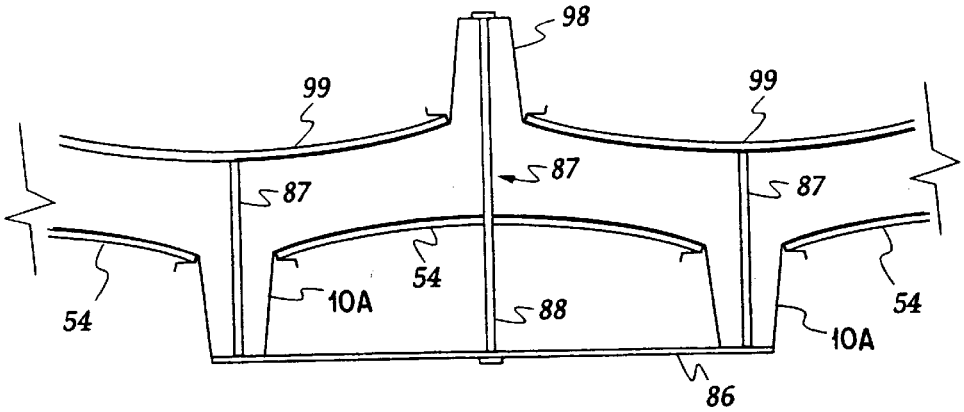
Figure 26B:
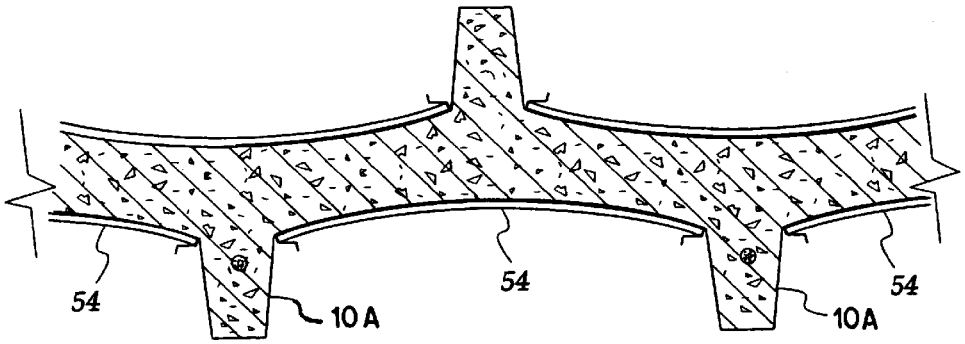

Alternatively as seen in FIGS. 26A and 26B, a thinner wall of equal strength or a greater surface area for the same volume of concrete can be constructed if the rib-forming channels are off-set. A double ribbed wall with off-set ribs is constructed by spacing rib-forming channels 10A off-set relative to other rib-forming channels 98 by means of stays 88 which connect the base of a rib-forming channel 98 to a bridge member 86 spanning between the bases of adjoining and opposite rib-forming channels 10A. Formwork modules 54 are spaced relative to other formwork modules 99 by struts 87 between the base of a rib-forming channel and an opposed formwork module.

In the embodiments of FIGS. 24, 25 and 26, the rib-forming channels and the panel-forming formwork modules are stripped for re-use by uncapping the releasably capped stay, stripping the channel and then stripping the formwork module.

It will be appreciated that the formwork, flooring system and construction method in accordance with the invention has a number of significant advantages over known systems. The formwork is of lighter gauge than planar formwork for a given strength and so is lighter and cheaper. This also enables the formwork to overlap and minimises slump drainage during the pour. The ability to overlap also enables added strength to be provided by overlapping the material.

The use of a formwork assembly having a plurality of individual smaller arched support modules saves time during construction leading to quicker construction methods at reduced labour costs. Moreover, the smaller lengths used in the formwork assembly described above have the potential to be more easily and cheaply manufactured by methods other than roll forming, such as pressing or stamping for example.

Because greater separation of beams is possible, fewer beams are required leading to further cost savings. For a given floor strength, less concrete is used therefore costs are reduced still further because of lower concrete costs as well as the potential for smaller foundations due to a reduction in dead loadings. The extra space beneath the floor provided by the archway enables a greater range of services to be run under the floor.

The ease of overlapping the beam formwork channels minimises wastage in comparison with systems where formwork is cut to length. The capacity to re-use the formwork provides significant cost benefits in comparison with systems where the formwork is not salvaged but rather remains in place. Such arrangements provide a finishing surface if a concrete surface is not required, but limit the surface to the material of the formwork and are expensive in comparison with the method of the present invention. The method of supporting the formwork in stable equilibrium can reduce set up times and improves safety.

In particular, because the beam-former is suspended at its upper edges in a cradle-like support bracket the base of which is wider than the neck, the downward resultant force due to workers stepping on the formwork or due to the weight of the concrete, is inside the support bracket and does not generate an unstable turning moment as occurs when the beam former is supported on its base as in prior art arrangements. Furthermore the suspended support of the present invention has the effect of centring the beam.

The invention enables standard beam-forming assemblies to be used whilst allowing the utilization of re-usable inserts to save on concrete costs where smaller beams can be used.

It will of course be realized that whilst the above has been given by way of an illustrative example of this invention, all such and other modifications and variations hereto, as would be apparent to persons skilled in the art, are deemed to fall within the broad scope and ambit of this invention as is herein claimed.

I claim:

1. A method of constructing a suspended floor, said method including:

positioning a plurality of support assemblies on a support base, and suspending a beam-forming formwork assembly from each said support assembly, each said support assembly supporting the beam-forming formwork assembly suspended therefrom in stable equilibrium.

2. A method as claimed in claim 1, wherein said plurality of beam-forming formwork assemblies are located in substantially parallel alignment.

3. A method as claimed in claim 1, wherein said support assemblies are substantially cradle-like and have arms converging from a base to define an open neck adapted to receive a beam-forming formwork assembly therethrough for suspended support therefrom.

4. A method as claimed in claim 3, said method including:

locating a plurality of floor-forming formwork assemblies between said beam-forming formwork assemblies for support thereon;

pouring concrete in said flooring and beam-forming formwork assemblies;

allowing the concrete to set, and removing the formwork assemblies from the set concrete for re-use.

5. A method as claimed in claim 3, wherein said beam-forming formwork assemblies include a plurality of beam-forming formwork modules having a channel member constituting a mould with side walls for forming a beam, first support means associated with each side wall of the channel member such that the channel member is supportable on a support assembly in stable equilibrium, and second support means associated with each side wall of the channel member for supporting floor-forming formwork assemblies transversely thereof.

6. A method as claimed in claim 5, wherein said floor-forming formwork assemblies include a plurality of floor-forming formwork modules adapted to withstand a construction point loading without failure.

7. A method as claimed in claim 6, wherein said floor-forming formwork modules are fixedly mounted in mounting means adapted to be supported on said second support means.

8. A method as claimed in claim 5, wherein said floor-forming formwork modules are arched.

9. A support assembly for supporting a beam-forming formwork module having a channel member constituting a mould for forming a beam and support means associated with each flange of the channel member, said support assembly including:

a substantially cradle-like member having arms converging from a base to define an open neck adapted to receive a beam-forming formwork module therethrough such that the channel member is suspended from the support assembly by said support means and supported thereby in stable equilibrium.

10. A support assembly as claimed in claim 9, wherein said base is arched.

11. A formwork system for a suspended floor, said system including:

a plurality of beam-forming formwork modules each having a channel member constituting a mould with side walls for forming a beam, first support means associated with each side wall of the channel member such that the channel member is supportable on a support assembly in stable equilibrium, and second support means associated with each side wall of the channel member for supporting floor-forming formwork assemblies transversely thereof;

a plurality of support assemblies for supporting said beam-forming formwork modules, the support assemblies being substantially cradle-like and having arms converging from a base to define an open neck adapted to receive a beam-forming formwork module therethrough such that the channel member is suspended from the support assembly by said first support means and supported thereby in stable equilibrium, and a plurality of arched floor-forming formwork modules extendable between beam-forming formwork modules and supportable on said second support means thereof.

12. A method of constructing a suspended floor, said method including:

positioning a plurality of support assemblies on a support base;

suspending a plurality of beam-forming formwork assemblies of given cross-section from said support assemblies, said beam-forming formwork assemblies being supported thereby in stable equilibrium, and suspending a beam-forming insert of lesser cross-section than said given cross-section in a beam-forming formwork assembly whereby a beam is formed when concrete is placed in said formwork assemblies.

13. A method as claimed in claim 12, wherein:

said beam-forming formwork assemblies include a plurality of beam-forming formwork modules having a channel member of given cross-section constituting a mould for forming a beam, first support means associated with each side wall of the channel member such that the channel member is supportable on a support assembly in stable equilibrium, and said beam-forming insert includes a channel member constituting a mould of lesser cross-section for forming a beam and flange means for supporting said channel member on said first support means.

14. A formwork system for a suspended floor, said system including:

a plurality of beam-forming formwork modules each having a channel member of given cross-section constituting a mould for forming a beam, first support means associated with each flange of the channel member such that the channel member is supportable on a support assembly in stable equilibrium, and second support means associated with each flange of the channel member for supporting flooring formwork assemblies transversely thereof;

a plurality of beam-forming inserts each having a channel member of lesser cross-section constituting a mould for forming a beam and flange means for supporting an insert on said first support means;

a plurality of support assemblies for supporting said beam-forming formwork modules, the support assemblies being substantially cradle-like and having arms converging from a base to define an open neck adapted to receive a beam-forming formwork module therethrough such that the channel member is suspended from the support assembly by said first support means and supported thereby in stable equilibrium, and a plurality of arched flooring formwork modules extendable between beam-forming formwork modules and supportable on said second support means thereof.

15. A flooring system for a suspended floor, the flooring system including:

a plurality of support beams having support means for supporting a formwork assembly, and at least one arched formwork assembly having a plurality of arched formwork modules adapted to withstand a construction point loading without failure, the modules being fixedly mounted in mounting means adapted to be supported on the support means.

16. A method of construction including:

preparing a support base for supporting a construction;

supporting a plurality of support members on the support base, the support members having support means for supporting a formwork assembly;

locating at least one arched formwork assembly between the support members to constitute formwork for the construction, the arched formwork assembly having a plurality of arched formwork modules fixedly mounted in mounting means adapted to be supported on the support means, and placing concrete in the formwork to form the construction.

17. A method of constructing a suspended floor, the method including:

preparing a support base for supporting the suspended floor;

locating a plurality of support beams on the support base, the support beams having support means for supporting a formwork assembly;

locating at least one arched formwork assembly between the beams to constitute formwork for the suspended floor, the arched formwork assembly having a plurality of arched formwork modules adapted to withstand a construction point loading without failure, the modules being fixedly mounted in mounting means adapted to be supported on the support means, and placing concrete in the formwork to form a suspended slab floor.

18. A method of constructing a suspended floor, the method including:

preparing a support base for supporting the suspended floor;

locating a plurality of beam-forming formwork assemblies on the support base, the beam-forming formwork assemblies having support means for supporting a floor-forming formwork assembly;

locating a plurality of arched floor-forming formwork assemblies on and between the beam-forming formwork assemblies to constitute formwork for the suspended floor, the arched floor-forming formwork assemblies having a plurality of arched floor-forming formwork modules adapted to withstand a construction point loading without failure, the modules being fixedly mounted in mounting means adapted to be supported on the support means, and placing concrete in the formwork to form the construction;

the arrangement being such that the beam-forming formwork assemblies and the floor-forming formwork assemblies can be re-used.

* * * * *